US007789654B2

(12) United States Patent
Lenard

(10) Patent No.: US 7,789,654 B2
(45) Date of Patent: Sep. 7, 2010

(54) SOAP HOLDING DEVICE HAVING DESIGN IMPRINTER

(76) Inventor: Mark B. Lenard, 1105 Hickory Crest Dr., New Lenox, IL (US) 60451

( * ) Notice: Subject to any disclaimer, the term of this patent is extended or adjusted under 35 U.S.C. 154(b) by 550 days.

(21) Appl. No.: 11/765,775

(22) Filed: Jun. 20, 2007

(65) Prior Publication Data

US 2008/0314769 A1 Dec. 25, 2008

(51) Int. Cl.
*B29C 59/00* (2006.01)
*B28B 3/00* (2006.01)
*B29C 43/54* (2006.01)

(52) U.S. Cl. ..... 425/385; 425/318; 425/395; 249/157

(58) Field of Classification Search ..... 425/385, 425/318, 395; 249/155, 157
See application file for complete search history.

(56) References Cited

U.S. PATENT DOCUMENTS 4,501,354 A * 2/1985 Hoffman ..... 206/77.1
4,501,355 A * 2/1985 Hoffman ..... 206/77.1

* cited by examiner

*Primary Examiner*—Maria Veronica D Ewald
(74) *Attorney, Agent, or Firm*—Davis Chin; Davis M. Chin, Jr.

(57) ABSTRACT

A soap holding device includes a base member having a first grid pattern with a plurality of apertures and a co-mating cover member having the capability of being lowered telescopically downwardly into the base member as a soap bar becomes smaller with use. The cover member also includes a second grid pattern with a plurality of apertures and an imprinting portion for imprinting designs onto the soap bar after every use when the cover member exerts pressure thereon to produce the capability of better skin exfoliation and deep cleansing.

7 Claims, 4 Drawing Sheets

SOAP HOLDING DEVICE HAVING DESIGN IMPRINTER

BACKGROUND OF THE INVENTION

1. Field of the Invention

This invention relates generally to soap holding devices, and more particularly, the present invention relates to an improved soap holding device formed of a base member and a co-mating cover or lid member. The cover member includes one grid-like pattern and a design both of which will be imprinted onto the soap after every use when the cover member is telescopically pressed downwardly into the base member. The base member includes another grid-like pattern that will also be imprinted onto the soap after every use.

2. Description of the Prior Art

Since the advent of soap holders, users have noticed that when the underside of a bar of soap is not thoroughly dried in the holder the soap becomes sticky, adheres to the bottom of the holder and is repulsive to the touch. As a result, many designs of soap holders have been attempted to resolve this inconvenience. Numerous designs have incorporated a limited number of drainage holes located at the bottom of the holder. Other designs have included raised protuberances to offset the soap from complete contact with the flat surface on the bottom of the holder. However, these attempts still result in having a substantial portion of the underside of the soap being left in a sticky, gelatinous condition.

Moreover, often times users place the wet bar of soap into a holder without considering the true topside or underside of the soap. Because many manufacturers of bars of soap imprint the topside of soaps with identifying marks, tradenames or decorative designs, it is to the manufacturers' advantage to maintain the imprint on the soap for as long as possible so that the consumer will associate the soap with the manufacturers' brand. However, after just a couple of uses of the soap, the imprint dissolves into the bar leaving a smooth surface without an imprint. When the user places the imprint-side of the soap facing the bottom of the holder, the imprint dissolves even quicker because the imprint becomes sticky and gelatinous due to inadequate drying.

In view of these problems, attempts have been made heretofore in the prior art to develop new implementations in soap holders so as to facilitate the drying of the underside of the soap. As discussed above, some improvements have included drainage holes and protuberances located at the bottom of the soap holder. Although these improvements may have performed adequately so as to allow the underside of the soap to dry better, these improvements only enhanced the drying capabilities of the holder slightly and none of the improvements considered the primary functions, like the objects in the present invention, of imprinting and/or scoring the wet bar of soap after every use.

Therefore, it should come as no surprise that soap holding devices have been developed and constructed heretofore in the prior art so as to increase the ability to dry the underside of the soap. In spite of these efforts in the prior art, it would be still desirable to provide an improved soap holding device which effectively dries more surface area of the underside of the soap and provides the ability to score and imprint designs onto the soap after every use.

A prior art search directed to the subject matter of this application in the U. S. Patent and Trademark Office revealed the following Letters Patent:

| | |
|---|---|
| 1,782,076 | 4,501,355 |
| 2,380,892 | 4,548,572 |
| 2,484,460 | 4,917,589 |
| 2,486,347 | 5,269,997 |
| 2,822,640 | Des. 341,972 |
| 3,094,758 | 6,439,874 |
| 3,446,900 | 6,554,246 |
| 4,035,122 | D499,919 |
| 4,344,529 | |

In U.S. Pat. No. 4,501,355 to Hoffman issued on Oct. 22, 1985, there is disclosed a soap saving device for pressure bonding two or more pieces of wet soap. The device comprises two dissimilar nesting soap dishes. The top soap dish is formed with a relatively shallow bed compared with the relatively deep bed of the bottom soap dish. This configuration provides a space for pieces of soap to be sandwiched between the nested soap dishes. Once the soap dishes are engaged, a pressure bonding force is applied to the pieces of soap, which forms a unitary bar. Additionally, two thumb-sized notches are provided on the top soap dish to enable a manual finger-thumb gripping of the bottom soap dish.

In U.S. Pat. No. 3,094,758 to Downie et al. issued on Jun. 25, 1963, an apparatus for pressing detergents is disclosed. A soft plastic die member has inverted lettering on the face for stamping detergent cakes to be pressed with brand identification or other descriptive material.

In U.S. Pat. No. 2,822,640 to Fuller issued on Feb. 11, 1958, there is disclosed a soap dish including a tray and a reversible grid, which allows for excess drainage of moisture. A number of legs or projections depend from the underside of the grid. The legs bear upon the floor of the tray and support the grid a distance above said floor.

In U.S. Pat. No. 4,035,122 to Cavanaugh issued on Jul. 12, 1977, there is disclosed another soap saving device which includes a housing that has a platen slidably mounted therein. A plunger is also slidably mounted within the housing. The plunger cooperates with the platen to provide a confined space of variable volume. The platen has an upper concave surface while the plunger has a lower concave surface. The platen also includes a plurality of apertures, which allows for the drainage of excess moisture within the housing. The device also includes a cover, which rests on the plunger. In operation, remnants of soap are placed within the confined space, and the cover is manually pushed down to exert a force sufficient enough to compress the remnants of soap into one unitary bar.

The remaining patents, listed above but not specifically discussed, are deemed to be only of general interest and show the state of the art in soap holding devices and their associated components.

None of the prior art discussed above discloses a soap holding device like that of the present invention which provides numerous drainage holes, located at the bottom of the soap holding device, to dry more surface area of the soap and provides simultaneously the ability to score and imprint designs onto the soap after every use so as to produce the capability of better skin exfoliation and deep cleansing while lathering the soap during the next use.

SUMMARY OF THE INVENTION

Accordingly, it is a general object of the present invention to provide an improved soap holding device which imprints designs onto the soap after every use, but yet overcomes the disadvantages of the prior art.

It is an object of the present invention to provide an improved soap holding device which scores or texturizes the surfaces of the soap with an impression so as to place a message or design after every use.

It is another object of the present invention to provide an improved soap holding device which scores or texturizes the surfaces of the soap bar with an impression so as to produce the capability of better skin exfoliation and deep cleansing due to both sides of the soap bar being scored or roughed up.

It is still another object of the present invention to provide an improved soap holding device which allows for the drying of a relatively larger surface area on the soap.

It is still yet another object of the present invention to provide an improved soap holding device which is cost effective to manufacture and which is relatively easy and non-problematic to use in operation.

In a preferred embodiment of the present invention, there is provided a soap holding device which allows for imprinting, scoring and expedient drying of a soap bar. The soap holding device includes a base member having a first grid pattern with a plurality of apertures and a cover member having the capability of being telescopically pressed downwardly into the base member as the soap becomes smaller with use in order to provide continual scoring and imprinting. The cover member also includes a second grid pattern with a plurality of apertures and an imprinting portion for imprinting designs onto the soap bar after every use.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENTS

Figure 1:
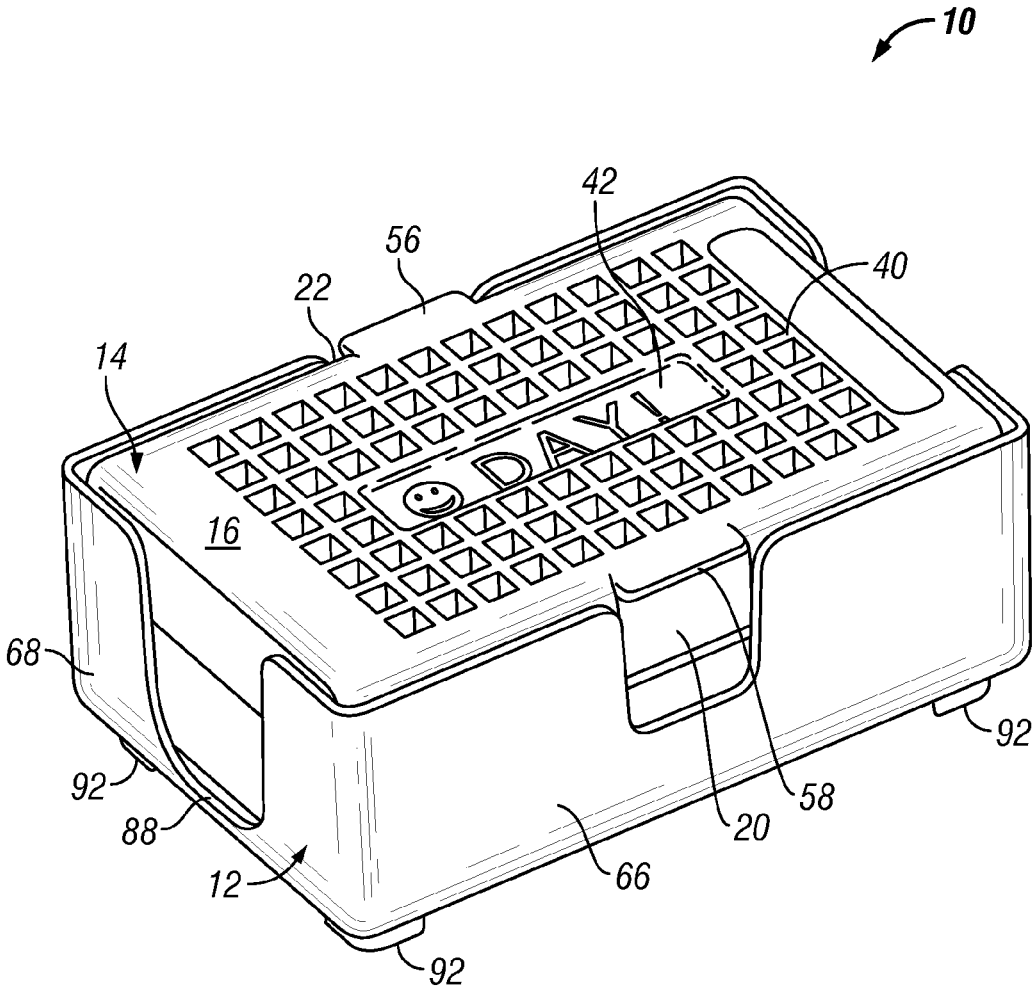
FIG. 1 is a perspective view of the assembled soap holder, constructed in accordance with the principles of the present invention.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

Referring now in detail to the drawings, wherein like reference characters designate like or corresponding parts throughout the several views, there is illustrated in FIGS. 1 through 8 an improved soap holding device 10 constructed in accordance with the principles of the present invention.

Figure 2:
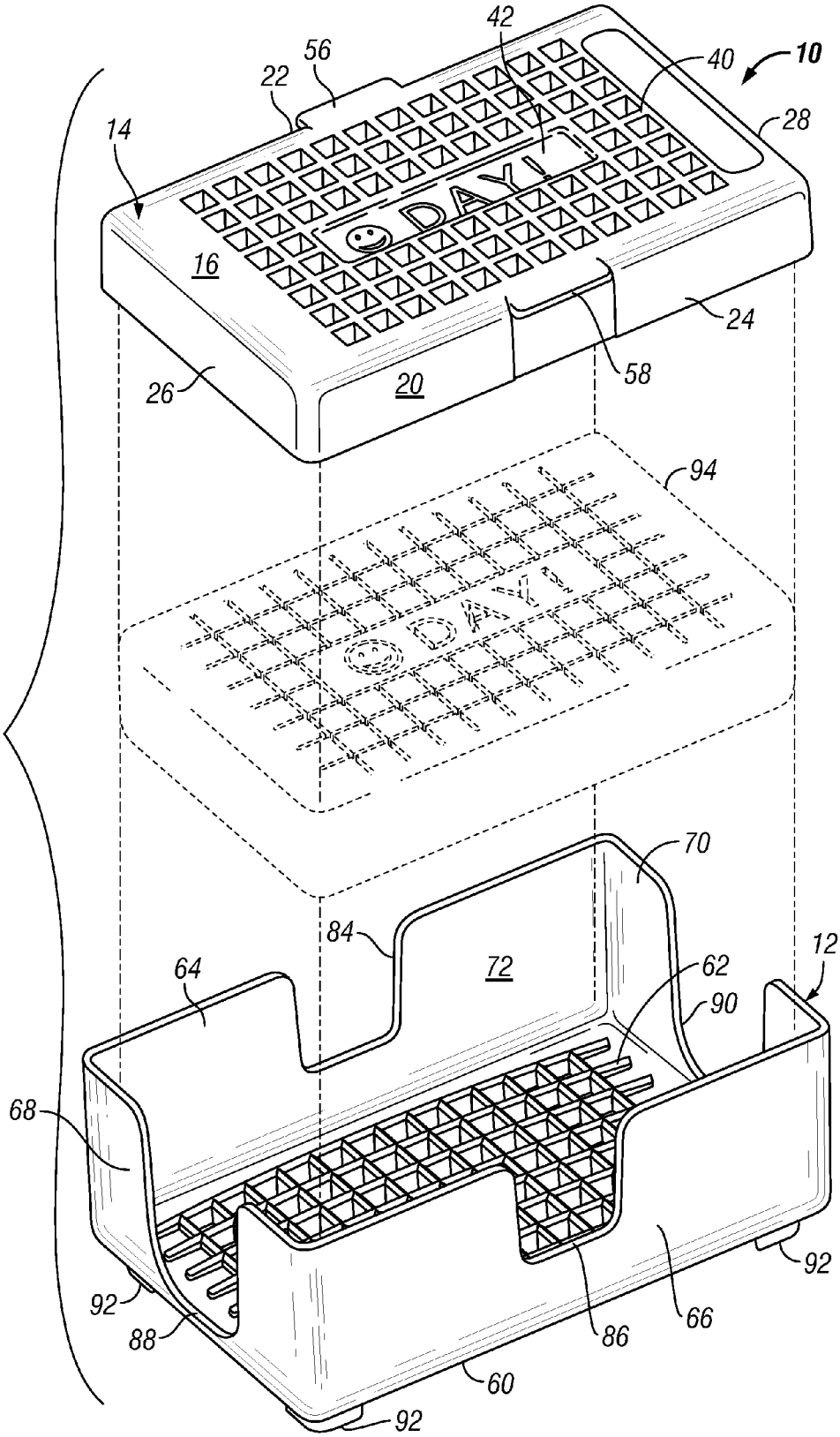
FIG. 2 is an exploded view of the soap holder of FIG. 1.

As shown in FIGS. 1 and 2, there is provided a soap holding device 10 which is defined by a base member 12 and a co-mating cover or lid member 14. The soap holding device 10 may be fabricated from plastic or any other similar formable material. The cover member 14 is designed to seat within and to be telescopically pressed downwardly into base member 12.

The cover member 14 is of a substantially rectangular configuration and includes a top surface 16, a bottom surface 18 and a downwardly-extending peripheral skirt 20, which is formed of a first side wall 22, a second side wall 24, a first end wall 26 and a second end wall 28. A first finger grip 56 laterally extends from the top surface 16 of the cover member 14, where the top surface 16 and the first side wall 22 of the skirt 20 are joined, at a substantially central location that is equidistant from the first and second end walls 26,28. In a like manner, a second finger grip 58 laterally extends from the top surface 16 of the cover member 14, where the top surface 16 and the second side wall 24 of the skirt 20 are joined, at a substantially central location that is equidistant from the first and second end walls 26,28. Further, the finger grips 56,58 are oppositely disposed from one another.

Figure 3:
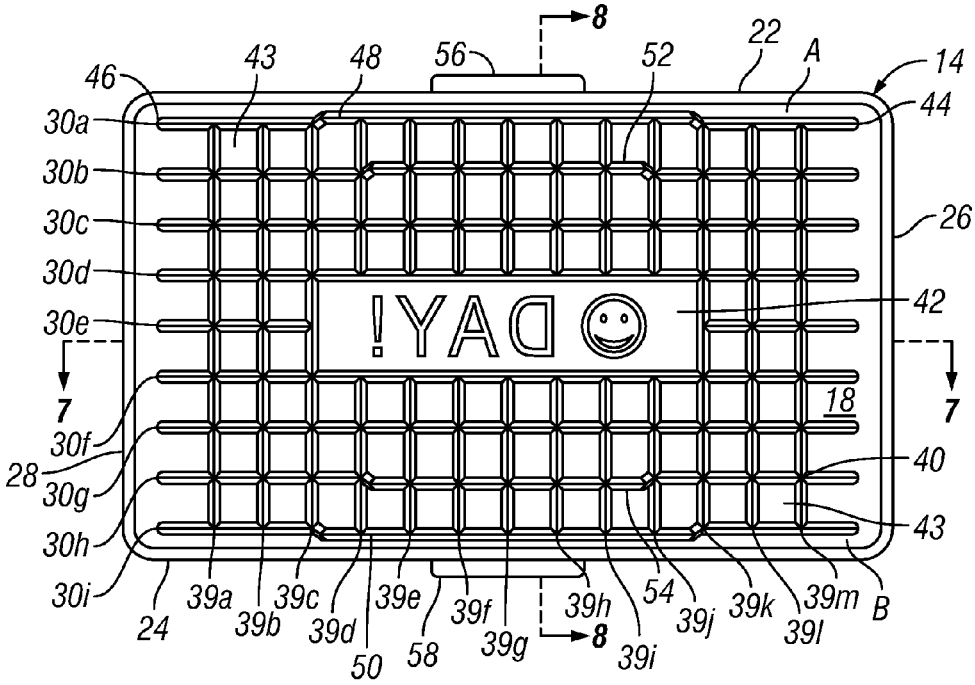
FIG. 3 is a bottom plan view of the cover member of the soap holder of FIG. 1.
Figure 7:
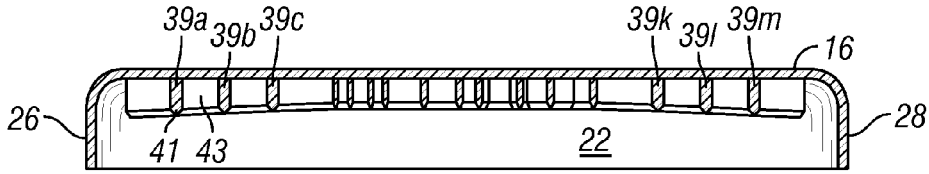
FIG. 7 is cross-sectional view, taken along the lines 7-7 of FIG. 3.
Figure 8:
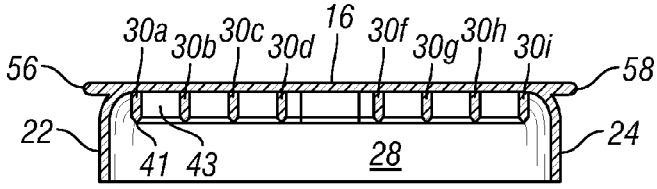
FIG. 8 is cross-sectional view, taken along the lines 8-8 of FIG. 3.

As shown in FIG. 3, the bottom surface 18 of the cover member 14 contains a series of nine evenly and equally spaced, raised horizontal edges 30*a*-30*i* and of thirteen evenly and equally spaced, raised vertical edges 39*a*-39*m*. The horizontal edges 30*a*-30*i* and the vertical edges 39*a*-39*m* intersect and are configured in such a manner so as to form a grid-like pattern 40. As shown in FIGS. 7 and 8, the edges 30*a*-30*i*, 39*a*-39*m* are slightly pointed or tapered downwardly to form tips 41 so that, during use, the grid-like pattern 40 will be imprinted onto the top surface of a soap bar 94 to produce the capability of better skin exfoliation and deep cleansing. The grid-like pattern 40 includes eight rows and twelve columns of identically, complete square-shaped apertures 43 that extend through to the top surface 16 of cover member 14.

Due to the fact that the grid-like pattern 40 also includes a design imprinting portion 42, the actual number of square-shaped apertures is eighty (80) instead of ninety six (96). The imprinting portion 42 is rectangular in shape and includes, for example, a raised smiley face design and raised lettering, which reads "DAY!". Alternately, the imprinting portion 42 may be fabricated to include any desired combination of designs and letterings, and is not limited to the design shown in the figures.

As illustrated in the bottom plan view of the cover member 14 in FIG. 3, the imprinting portion 42 is preferably located between the vertical edges 39*c* and 39*k* and between the horizontal edges 30*d* and 30*f* of the grid-like pattern 40. However, it should be understood by those skilled in the art that the imprinting portion 42 may be suitably located anywhere within the grid-like pattern 40 and that the position of imprinting portion 42 described above is used only to illustrate the best mode of the preferred embodiment of the present invention.

Still referring to FIG. 3, the raised horizontal edge 30*a* has a first end 44 which is located at a slight distance inwardly from the first end wall 26 of the peripheral skirt 20 and has a second end 46 which is located at a slight distance inwardly from the second end wall 28 of the skirt 20. The raised horizontal edge 30*a* traverses partially the entire length of the first side wall 22.

The length of raised horizontal edge 30*a* is positioned at a slight distance inwardly from the first side wall 22 creating a narrow space A between the edge 30*a* and the side wall 22. In a similar fashion, the length of raised horizontal edge 30*i* is positioned at a slight distance inwardly from the second side wall 24 creating a narrow space B between the edge 30*i* and the side wall 24. As shown in FIG. 3, the ends of raised horizontal edge 30*i* are configured the same distance from the end walls 26,28 as the ends 44,46 of the raised horizontal edge 30*a*. The ends of the rest of raised horizontal edges 30*b*-30*h* are also configured the same distance from the end walls 26,28 and are evenly and equally spaced between the distance of the raised edges 30*a*,30*i*.

As further shown in FIG. 3, the raised horizontal edges 30*a*,30*i* have raised ridges 48,50, respectively, that extend from the vertical edges 39*c* to 39*k*. Similarly, the raised horizontal edges 30*b*,30*h* have raised ridges 52,54, respectively, that extend from the vertical edges 39*d* to 39*j*.

The heights of the ends of the raised horizontal edges 30*a*-30*i* are approximately one-third of the height of the peripheral skirt 20. However, proceeding along the length of each raised horizontal edge 30*a*-30*i*, from each end, toward the middle, the height of the raised horizontal edges gradually and uniformly decrease creating a concave shape. Thus, when viewed from the bottom surface 18 of the cover member 14, as in FIGS. 3 and 7, the overall contour of the grid-like pattern 40 is of a concave shape in the direction of the end walls 26,28 of the skirt 20. The contour of the grid-like pattern 40 may alternately also be convex or flat to appropriately fit the contours of different shapes of soap.

Now referring again to FIG. 2, base member 12 has a substantially rectangular shape and includes an outer bottom surface 60 and an inner bottom surface 62. Extending vertically and upwardly from inner bottom surface 62 are a first side wall 64, a second side wall 66, a first end wall 68 and a second end wall 70, which collectively form a soap receiving reservoir 72.

Figure 4:
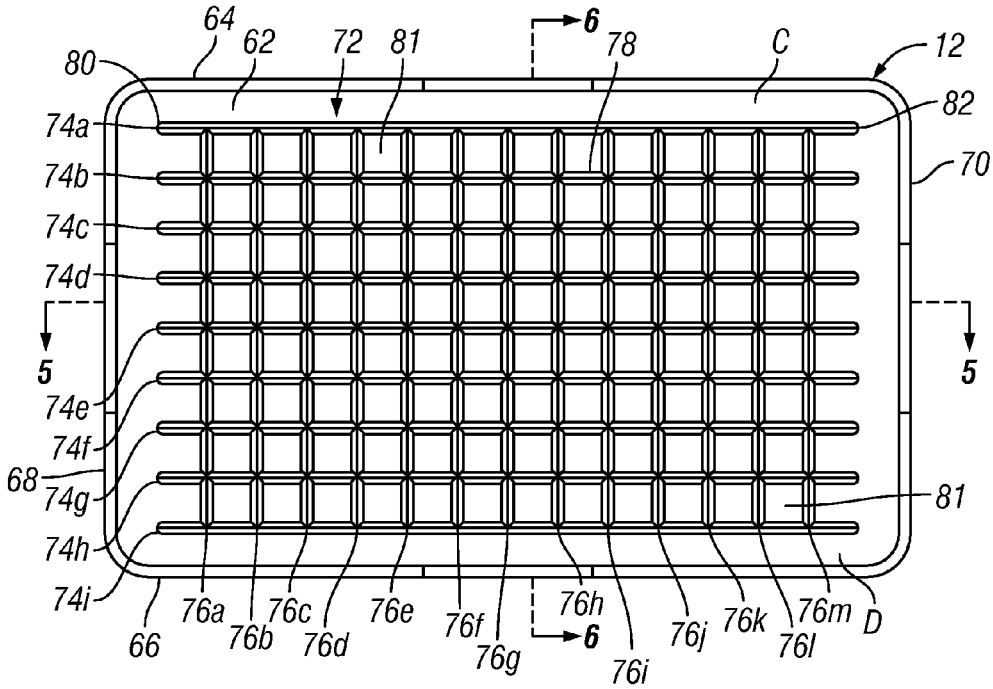
FIG. 4 is a top plan view of the base member of the soap holder of FIG. 1.
Figure 5:
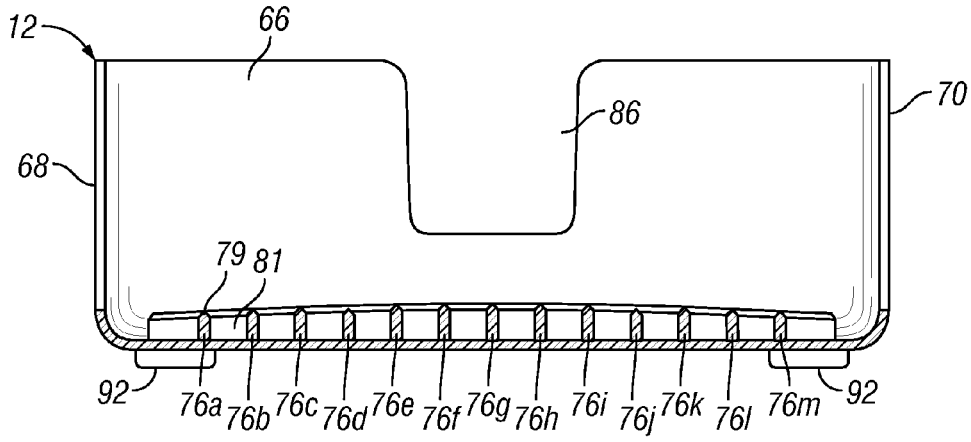
FIG. 5 is cross-sectional view, taken along the lines 5-5 of FIG. 4.
Figure 6:
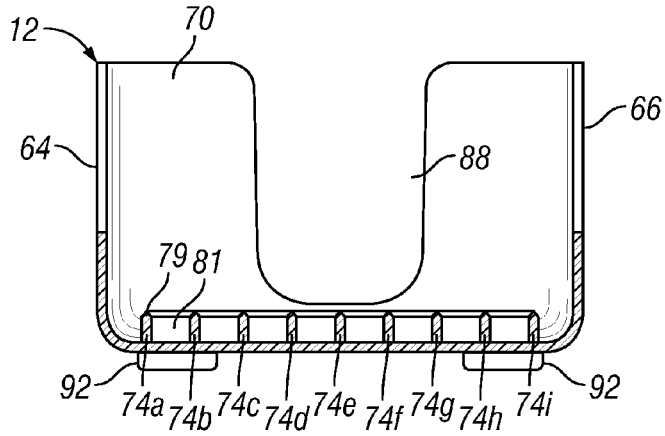
FIG. 6 is cross-sectional view, taken along the lines 6-6 of FIG. 4.

As illustrated in FIG. 4, the inner bottom surface 62 of the base member 12 contains a series of nine evenly and equally spaced, raised horizontal edges 74*a*-74*i* and of thirteen evenly and equally spaced, raised vertical edges 76*a*-76*m*. The horizontal edges 74*a*-74*i* and the vertical edges 76*a*-76*m* intersect and are configured in such a manner so as to form a grid-like pattern 78. As shown in FIGS. 5 and 6, the edges 74*a*-74*i*, 76*a*-76*m* are slightly pointed or tapered upwardly to form tips 79 so that, during use, the grid-like pattern 78 will be imprinted onto the bottom surface of the bar of soap 94 to produce the capability of better skin exfoliation and deep cleansing. The grid-like pattern 78 includes eight rows and twelve columns of identically, complete square-shaped apertures 81 that extend through to outer bottom surface 60 of base member 12.

The raised horizontal edge 74*a* has a first end 80 which is located at a slight distance inwardly from the first end wall 68 and has a second end 82 which is located at a slight distance inwardly from the second end wall 70. The raised horizontal edge 74*a* traverses partially the entire length of the first side wall 64.

The length of raised edge 74*a* is positioned at a slight distance inwardly from the first side wall 64 creating a narrow space C between the edge 74*a* and the side wall 64. In a similar fashion, the length of raised horizontal edge 74*i* is positioned at a slight distance inwardly from the second side wall 66 creating a narrow space D between the edge 74*i* and the side wall 66. As shown in FIG. 4, the ends of the raised edge 74*i* are configured the same distance from the end walls 68,70 as the ends 80,82 of raised horizontal edge 74*a*. The ends of the rest of raised horizontal edges 74*b*-74*h* are also configured the same distance from the end walls 68,70 and are evenly and equally spaced between the distance of the raised horizontal edges 74*a*, 74*i*.

Proceeding along the length of each raised edge 74*a*-74*i*, from each end, toward the middle, the height of the raised edges gradually and uniformly increase creating a convex shape. Thus, when viewed from the inner bottom surface 62 of the base member 12, as in FIG. 4 and in the cross-sectional view of FIG. 5, the overall contour of the grid-like pattern 78 is of a convex shape in the direction of the end walls 68,70 of the base member 12. The contour of the grid-like pattern 78 may alternately also be concave or flat to appropriately fit the contours of different shapes of soap.

As shown in FIG. 2, a pair of oppositely disposed trapezoidally-shaped cutouts 84,86 is centrally located on the side walls 64,66, respectively. The trapezoidally-shaped cutouts 84,86 are designed to receive the finger grips 56,58, respectively, when the cover member 14 is lowered telescopically downwardly into base member 12 as the soap becomes smaller with use to provide continual scoring and imprinting. A pair of oppositely disposed U-shaped cutouts 88,90 is centrally located on the end walls 68,70, respectively. The U-shaped cutouts 88,90 are designed to provide an easy way to remove the soap from the base member 12.

As can best be seen in FIGS. 1 and 2, four rounded L-shaped legs 92 (three of which are shown) are located on the outer bottom surface 60 of the base member 12. One of the legs is positioned in each on the respective four corners of the outer bottom surface 60.

In operation, a user places the wet bar of soap 94 into the soap receiving reservoir 72 of the base member 12. The user then places the cover member 14 over the soap and into the base member 12. The cover member 14 will be resting on the top of the soap 94 as shown in FIG. 1. Now that the wet soap is sandwiched between the base member 12 and cover member 14 the user will apply an evenly distributed amount of pressure downwardly onto the cover member 14. Because the soap is wet, the applied pressure to the cover member 14 is sufficient to imprint the grid-like patterns 40,78 and design imprinting portion 42 onto the soap 94 after every use. The soap will have the newly imprinted design on the soap following each use thereof for the visual pleasure of the user. Plus, the newly imprinted and texturized soap will have slightly rough and uneven edges of the grid-like patterns on both sides of the soap bar so as to aid a user with skin exfoliation and deep cleansing while lathering the soap during the next use. The user can easily remove the soap 94 from the device 10 by lifting up the cover member 14 at finger grips 56,58 and then lifting up the soap by the sides via the U-shaped cutouts 88,90 of the base member 12.

The application of the grid-like patterns 40,78 are not limited to imprinting the soap as described above, but also include the feature of allowing adequate air flow into the soap holding device 10 so as to effectively dry the wet soap. Because the legs 92 are of a sufficient height to raise or support the outer bottom surface 60 of base member 12 from direct contact of a stationary surface, such as a bathroom counter or shower floor, excess moisture is drained through the grid-like pattern 78, thereby expediting the drying of the wet soap 94 before the next use thereof.

From the foregoing detailed description, it can thus be seen that the present invention provides an improved soap holding device which includes design imprinting capabilities. As a result, the soap holding device of the present invention is relatively easy to use, scores or texturizes both surfaces of the soap after every use with an impression to produce the capability of better skin exfoliation and deep cleansing and allows for the drying of a relatively larger surface area on the soap.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. A soap holding device adapted for imprinting, scoring and drying a wet soap bar, comprising:

a base member having a surface with a first grid pattern;

said first grid pattern of said base member including a plurality of apertures;

opposed first and second side walls and opposed first and second end walls extending vertically and upwardly from said surface of said base member, collectively forming a reservoir for holding the wet soap bar;

said opposed first and second side walls having U-shaped cutouts;

said opposed first and second end walls having trapezoidally-shaped cutouts;

said base member including first through fourth legs;

a cover member having the capability of being lowered telescopically downwardly into said base member as the soap bar becomes smaller with use;

said cover member having opposed finger grips, a top surface, a bottom surface, a downwardly-extending peripheral skirt and a second grid pattern;

said downwardly-extending peripheral skirt being formed of a first side wall, a second side wall, a first end wall and a second end wall;

said opposed finger grips laterally extending from said top surface of said cover member at a substantially central location that is equidistant from said first and second end walls along said first and second side walls;

said second grid pattern of said cover member including a plurality of apertures formed in rows and columns that extend through said top surface of said cover member and an imprinting portion located substantially in the center of said cover member for impressing designs onto said wet soap bar after every use when said cover member exerts pressure thereon.

2. A soap holding device as claimed in claim 1, wherein said second grid pattern of said cover member is formed of one of a concave, convex and flat contour to fit the shape of said wet soap bar.

3. A soap holding device as claimed in claim 1, wherein said second grid pattern of said cover member is formed of a series of equally spaced, raised horizontal edges and of equally spaced, raised vertical edges intersecting said horizontal edges.

4. A soap holding device as claimed in claim 3, wherein said horizontal edges and said vertical edges of said cover member are tapered downwardly to form tips so that, during use, the second grid pattern of said cover member will be imprinted onto the top surface of the wet soap bar to produce the capability of better skin exfoliation and deep cleansing.

5. A soap holding device as claimed in claim 1, wherein said first grid pattern of said base member is formed of one of a concave, convex and flat contour to fit the shape of said wet soap bar.

6. A soap holding device as claimed in claim 1, wherein said first grid pattern of said base member is formed of a series of equally spaced, raised horizontal edges and of equally spaced, raised vertical edges intersecting said horizontal edges.

7. A soap holding device as claimed in claim 6, wherein said horizontal edges and said vertical edges of said base member are tapered upwardly to form tips so that, during use, the first grid pattern of said base member will be imprinted onto the bottom surface of the wet soap bar to produce the capability of better skin exfoliation and deep cleansing.

* * * * *